US008913769B2

(12) United States Patent
Feilner et al.

(10) Patent No.: US 8,913,769 B2
(45) Date of Patent: Dec. 16, 2014

(54) HEARING SYSTEM AND METHOD FOR OPERATING A HEARING SYSTEM

(75) Inventors: Manuela Feilner, Herrliberg (CH); Hilmar Meier, Zurich (CH); Michael Boretzki, Ruti (CH); Harald Krueger, Affoltern am Albis (CH); Ivo Spieler, Kusnacht (CH); Elmar Fichtl, Oetwil am See (CH)

(73) Assignee: Phonak AG, Stafa (CH)

( * ) Notice: Subject to any disclaimer, the term of this patent is extended or adjusted under 35 U.S.C. 154(b) by 1050 days.

(21) Appl. No.: 12/682,795

(22) PCT Filed: Oct. 16, 2007

(86) PCT No.: PCT/EP2007/061034

§ 371 (c)(1), (2), (4) Date: Apr. 13, 2010

(87) PCT Pub. No.: WO2009/049672

PCT Pub. Date: Apr. 23, 2009

(65) Prior Publication Data

US 2010/0220879 A1 Sep. 2, 2010

(51) Int. Cl.
*H04R 25/00* (2006.01)

(52) U.S. Cl.
CPC ..... *H04R 25/70* (2013.01); *H04R 2225/39* (2013.01); *H04R 2225/41* (2013.01)
USPC ..... 381/314; 381/312; 381/60

(58) Field of Classification Search
USPC ..... 381/314, 312, 60
See application file for complete search history.

(56) References Cited

U.S. PATENT DOCUMENTS 5,604,812 A 2/1997 Meyer
2003/0215105 A1 11/2003 Sacha (Continued)

FOREIGN PATENT DOCUMENTS

EP 0788290 A1 8/1997
EP 1363473 A2 11/2003

(Continued)

OTHER PUBLICATIONS

International Search Report for PCT/EP2007/061034 dated Jun. 3, 2008.

(Continued)

*Primary Examiner* — Duc Nguyen
*Assistant Examiner* — Taunya McCarty
(74) *Attorney, Agent, or Firm* — Pearne & Gordon LLP

(57) ABSTRACT

The method for operating a hearing system comprising at least one hearing device; at least one signal processing unit; at least one user control by means of which at least one audio processing parameter of said signal processing unit is adjustable; and a sensor unit; comprises the steps of a) obtaining adjustment data (userCorr) representative of adjustments of said at least one parameter carried out by operating said at least one user control;

b) obtaining characterizing data (p1;p2) from data outputted from said sensor unit substantially at the time said adjustment data are obtained;

c) deriving correction data (learntCorr) from said adjustment data (userCorr); wherein step c) is carried out in dependence of said characterizing data; and d) recognizing an update event; and, upon step d):

e) using corrected settings for said at least one audio processing parameter in said signal processing unit, which corrected settings are derived in dependence of said correction data (learntCorr).

An improved automatic adaptation of the audio processing properties of the hearing system the hearing system user's preference can be achieved.

16 Claims, 4 Drawing Sheets

(56) References Cited

U.S. PATENT DOCUMENTS

| | | | | |
|---|---|---|---|---|
| 2004/0208331 | A1* | 10/2004 | Chalupper | 381/314 |
| 2005/0129262 | A1 | 6/2005 | Dillon et al. | |
| 2006/0198530 | A1 | 9/2006 | Fischer et al. | |
| 2006/0210103 | A1 | 9/2006 | Van den Heuvel | |
| 2006/0215860 | A1 | 9/2006 | Wyrsch | |
| 2006/0222194 | A1 | 10/2006 | Bramslow et al. | |
| 2007/0230726 | A1 | 10/2007 | Giesner et al. | |
| 2008/0107278 | A1* | 5/2008 | Roeck et al. | 381/60 |

FOREIGN PATENT DOCUMENTS

| | | | |
|---|---|---|---|
| EP | 1404152 | A2 | 3/2004 |
| EP | 1708543 | A1 | 10/2006 |
| EP | 1 841 286 | A2 | 10/2007 |
| WO | 01/26419 | A1 | 4/2001 |
| WO | 2007/110073 | A1 | 10/2007 |

OTHER PUBLICATIONS

Written Opinion for PCT/EP2007/061034 dated Jun. 3, 2008.

Sulzmann et al, "On Pairwise Naive Bayes Classifiers," Machine Learning: ECML 2007 Lecture Notes in Computer Science, Springer Berlin Heidelberg, BE, vol. 4701, Jan. 1, 1900, pp. 371-381, XP019071393.

* cited by examiner

HEARING SYSTEM AND METHOD FOR OPERATING A HEARING SYSTEM

TECHNICAL FIELD

The invention relates to the field of hearing systems and hearing devices. It relates to methods and apparatuses according to the opening clause of the claims. In particular, it relates to the adapting of audio processing properties of hearing devices and hearing systems to the preferences of a user, which is also known as "fitting" of hearing devices/hearing systems.

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear, in the ear, completely in the ear canal or may be implanted.

A hearing system comprises at least one hearing device. In case that a hearing system comprises at least one additional device, all devices of the hearing system are operationally connectable within the hearing system.

Typically, said additional devices such as another hearing device, a remote control or a remote microphone, are meant to be worn or carried by said individual.

Under audio signals we understand electrical signals, analogue and/or digital, which represent sound.

BACKGROUND OF THE INVENTION

It is common in hearing devices that the user of a hearing device can adjust audio processing parameters such as parameters influencing the volume or the tonal balance, possibly even the compression, the beam-former setting, bass, treble or noise suppression. Usually, such adjustments are temporary, i.e. when switching off the hearing device, the adjustments are "forgotten", i.e. reset to default values (default parameter settings). When a hearing device uses a classifier for classifying a current acoustic environment and selecting audio processing parameters in dependence of such a classification, the before-mentioned adjustments may even be "forgotten" as soon as the acoustic environment changes.

In a conventional procedure for optimizing the adaptation of the audio processing properties of a hearing device to the preferences of the user, the user will verbally report his preferences to his hearing device professional (audiologist, fitter) during a fitting session, and the hearing device professional will change the default parameter settings accordingly. This can be a rather cumbersome procedure.

From U.S. Pat. No. 5,604,812, a hearing device is known, which employs fuzzy logic or neural network technology in order to let the hearing device automatically calculate improved audio processing parameter settings. Such algorithms require large processing power and do sometimes provide unreliable results.

In US 2005/0129262 A1, a programmable auditory prosthesis with trainable automatic adaptation to acoustic conditions is disclosed.

US 2006/0215860 A1 discloses a hearing device and a method for choosing a program in a multi program hearing device.

US 2004/0208331 A1 discloses a device and a method to adjust a hearing device. The method comprises: inputting a desired setting value in the hearing device at a determinable point in time; measuring at least one sound quantity concerning a first environment situation at the determinable point in time; automatically learning setting values to be used, depending on the desired setting value and the at least one measured sound quantity; newly measuring at least one sound quantity concerning a second environment situation; and adjusting the hearing device to one of the setting values to be used with regard to the second environment situation.

In US 2006/0222194 A1 is disclosed a hearing aid for recording data and learning therefrom.

From EP 0 788 290 A1, a programmable hearing aid-device is known. It is disclosed to analyze audio signals in the frequency domain and to use the result of such an analysis for selecting stored parameters of an amplification and transmission member or for changing the amplification and transmission characteristics of the amplification and transmission member.

In EP 1 404 152 A2, a hearing-aid device is presented, which is adaptable to certain hearing situations. A continuous individual adaptation of the hearing-aid device in different hearing situations is achieved.

It is desirable to provide an alternative way of adapting the audio processing properties of a hearing system to the preferences of a user of the hearing system.

SUMMARY OF THE INVENTION

One object of the invention is to create an alternative way of adapting the audio processing properties of a hearing system to the preferences of a user of the hearing system; in particular a way that does not have the disadvantages of the method and devices of the state of the art mentioned above. A method for operating a hearing system shall be provided, and, in addition, a corresponding hearing system and a corresponding computer program product shall be provided.

One object of the invention is to provide a way to fit a hearing system, which produces reliable results.

One object of the invention is to provide a way to fit a hearing system, which does not require a lot of storage space.

One object of the invention is to provide a way to fit a hearing system, which does not require large computing power.

One object of the invention is to provide a way to fit a hearing system, which works (predominantly) autonomously.

Further objects emerge from the description and embodiments below.

At least one of these objects is at least partially achieved by apparatuses and methods according to the patent claims.

The method for operating a hearing system comprising at least one hearing device;

at least one signal processing unit;

at least one user control by means of which at least one audio processing parameter of said signal processing unit is adjustable;

a sensor unit;

comprises the steps of a) obtaining adjustment data representative of adjustments of said at least one parameter carried out by operating said at least one user control;

b) obtaining characterizing data from data outputted from said sensor unit substantially at the time said adjustment data are obtained;

c) deriving correction data from said adjustment data;

wherein step c) is carried out in dependence of said characterizing data; and d) recognizing an update event; and, upon step d):

e) using corrected settings for said at least one audio processing parameter in said signal processing unit, which corrected settings are derived in dependence of said correction data.

In one aspect, said method for operating a hearing system can be considered a method for adjusting a hearing system, in particular the sound processing properties of a hearing system, to the preference of a user of the hearing system.

The hearing system comprises at least one hearing device;

at least one signal processing unit;

a user interface comprising at least one user control by means of which at least one audio processing parameter of said signal processing unit is adjustable;

a sensor unit;

a control unit operationally connected to each of the above elements;

wherein said control unit is adapted to a) obtaining adjustment data representative of adjustments of said at least one parameter carried out by operating said at least one user control;

b) obtaining characterizing data from data outputted from said sensor unit substantially at the time said adjustment data are obtained;

c) deriving correction data from said adjustment data;

wherein step c) is carried out in dependence of said characterizing data; and d) recognizing an update event; and, upon step d):

e) using corrected settings for said at least one audio processing parameter in said signal processing unit, which corrected settings are derived in dependence of said correction data.

The computer program product comprises program code for causing a computer to perform the steps of A) obtaining adjustment data representative of adjustments of at least one audio processing parameter of a signal processing unit of a hearing system carried out by operating at least one user control of said hearing system;

B) obtaining characterizing data from data outputted from a sensor unit of said hearing system substantially at the time said adjustment data are obtained;

C) deriving correction data from said adjustment data;

wherein step c) is carried out in dependence of said characterizing data; and

D) recognizing an update event; and, upon step d):

E) using corrected settings for said at least one audio processing parameter in said signal processing unit, which corrected settings are derived in dependence of said correction data.

In one embodiment, said computer is comprised in said hearing system.

The computer-readable medium comprises a computer program product according to the invention.

Through this, an improved adaptation of the signal processing properties of the hearing system to the preferences of a user of the hearing system can be achieved.

The steps of a method according to the invention may take place in said hearing device or elsewhere in the hearing system; they may, in particular, be partially carried out in said hearing device and partially in one or more other devices of the hearing system.

The members of a hearing system according to the invention may be comprised in said hearing device or maybe distributed among one or more devices of the hearing system including or excluding the hearing device.

For example, said signal processing unit is typically comprised in said hearing device. Said user interface can be comprised in said hearing device and/or in a remote control comprised in the hearing system.

Said operating said at least one user control mentioned in step a) is typically carried out by a user of the hearing system.

Said update event can be, e.g., a start-up of said hearing system or of said hearing device, or a particular operation of said user interface.

In one embodiment, a time-dependent function is used for carrying out step c). In other words, step c) comprises using a time-dependent function; step c) is carried out in a time-dependent fashion. For example, said time-dependent function can describe a time-integration, more particularly a time-dependent time integration over substantially said adjustment data. Preferably, in said time-dependent function or time integration, more recent adjustment data are weighted stronger than adjustment data which occurred a longer time ago.

In one embodiment, step c) is carried out such that said correction data develop in time towards said adjustment data.

Preferably, said correction data evolve towards said adjustment data in a preferably gradual fashion.

In one embodiment, said time-dependent function is a recursive function. In said recursive function, it is possible to obtain new correction data from recent correction data and current adjustment data. For example, a correction data value at a time t2 can be derived as a function depending on a correction data value at a time t1 before t2 and on an adjustment data value at t2. In a more mathematical formulation:

$$\text{learntCorr}(t2)=f(\text{learntCorr}(t1),\text{userCorr}(t2)),$$

with f: a function, learntCorr: correction data, userCorr: adjustment data.

The function may further depend on t1 and/or t2, in particular on the time difference t1-t2.

The points in time at which new correction data are obtained can be pre-determined, in particular be substantially regularly spaced. It is also possible that these points in time are determined in an event-driven fashion, in the sense that new correction data are obtained (step c)), e.g., also or only when new adjustment data are obtained (step a)).

In one embodiment, step c) is carried out several times after each other, wherein the result of later-obtained correction data depends on before-obtained correction data.

In an important embodiment, step c) is carried out during normal operation of the hearing system. I.e. step c) does not have to be carried out offline; it is carried out while the hearing system user uses his hearing system. Note that corrected settings (which depend on correction data) are not used before an update event occurred.

Data logging is known in the state of the art. By data logging, data such as the adjustment data mentioned above are recorded in the hearing system. See, e.g., EP 1 414 271 A2 for details on data logging in hearing devices. This allows a thorough evaluation of the recorded data by a hearing device professional, typically after recording data for several days or weeks, which requires a considerable amount of storage space. Data logging can, of course, be used in conjunction with the present invention, too. But when, as described above, a time-dependent function is used for deriving correction data (step c)), continuously improved correction data can be obtained without the need to store large amounts of adjustment data.

As has been pointed out, step c) is carried out in dependence of said characterizing data. I.e. (newly) obtained correction data will depend on the characterizing data, and in particular, it is possible to adjust the amount to which the adjustment data contribute to (newly) obtained correction data in dependence of the characterizing data.

In one embodiment, said time-dependent function describes a weighted averaging function.

The use of a weighted averaging function can have the advantage that values/events of the more distant past contribute less to the result than more recent values/events.

In one embodiment, said sensor unit receives sound. In particular, said sensor unit receives sound from the acoustic environment of a user of said hearing system. In other words, said characerizing data can be characteristic for said received sound and, more particularly, for the acoustic environment said user is located in.

In one embodiment, said characterizing data comprise data characterizing acoustical properties of said received sound. Such properties can be, e.g., the sound pressure level, the shape of the frequency spectrum.

In one embodiment, said sensor unit comprises a classifying unit for classifying said received sound according to N sound classes, with an integer N≥2.

Typically, four classes, sometimes three or five or six, possibly even more classes are used. Classification of sound is well known in the art of hearing devices. It is used for choosing an appropriate set of audio processing parameters for processing sound in a hearing device depending on the acoustic environment the user is in.

Note that, as depicted above, classification is here not necessarily used for choosing an appropriate set of audio processing parameters for processing sound in a hearing device, but for deriving correction data. It is possible that in a hearing device or hearing system, both is carried out. But it is also possible that classification is not used for adjusting currently used audio processing parameters, while nevertheless classification is used for deriving correction data. And it is also possible that in the same hearing device or hearing system, classification is carried out for both above-stated purposes, but with (at least partially) different classes according to which the classifications are carried out.

In one embodiment, said characterizing data comprise similarity factors which are indicative of the similarity between said received sound and sound representative of a respective class.

In one embodiment, the method comprises the step of g) deriving, on the basis of input audio signals derived from said received sound and for each class of N classes each of which describes a predetermined acoustic environment, a class similarity factor indicative of the similarity of a current acoustic environment as represented by said received sound with the predetermined acoustic environment described by the respective class, wherein N is an integer with N≥2.

In one embodiment, said hearing system comprises a storage unit comprising at least one set of base parameter settings for each of said classes, wherein said correction data are derived for each of said classes, and wherein for each of said classes, corrected settings are derived in dependence of the correction data and of said base parameter settings of the respective class.

Typically, for each adjustable (and enabled) parameter and for each class, corrected settings are obtained in the following manner:

corrected settings=function(base parameter settings, correction data), or more particularly for example:

corrected settings=base parameter settings+correction data.

It is possible to provide configuration steps in the invention. For example, it is possible to allow to select (enable) those audio processing parameters (and/or corresponding user controls), for which adjustment data and/or correction data shall be obtained (calculated). And it is possible to provide that said time-dependent function is selectable, in particular values which influence the "speed of learning" such as the speed with which said correction data converge towards said adjustment data. And it is possible to provide that said classes can be selected or determined.

Such configuration issues will typically be handled by a hearing device professional such as an audiologist or acoustician.

In one embodiment, said hearing system is identical with said hearing device.

Of course, several of the embodiments described above can be combined with each other (pair-wise or more).

Note that the invention comprises hearing systems and computer program products with features of corresponding methods according to the invention, and vice versa.

The advantages of the methods correspond to the advantages of corresponding apparatuses.

Further embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. The described embodiments are meant as examples and shall not confine the invention.

DETAILED DESCRIPTION OF THE INVENTION

Figure 1:
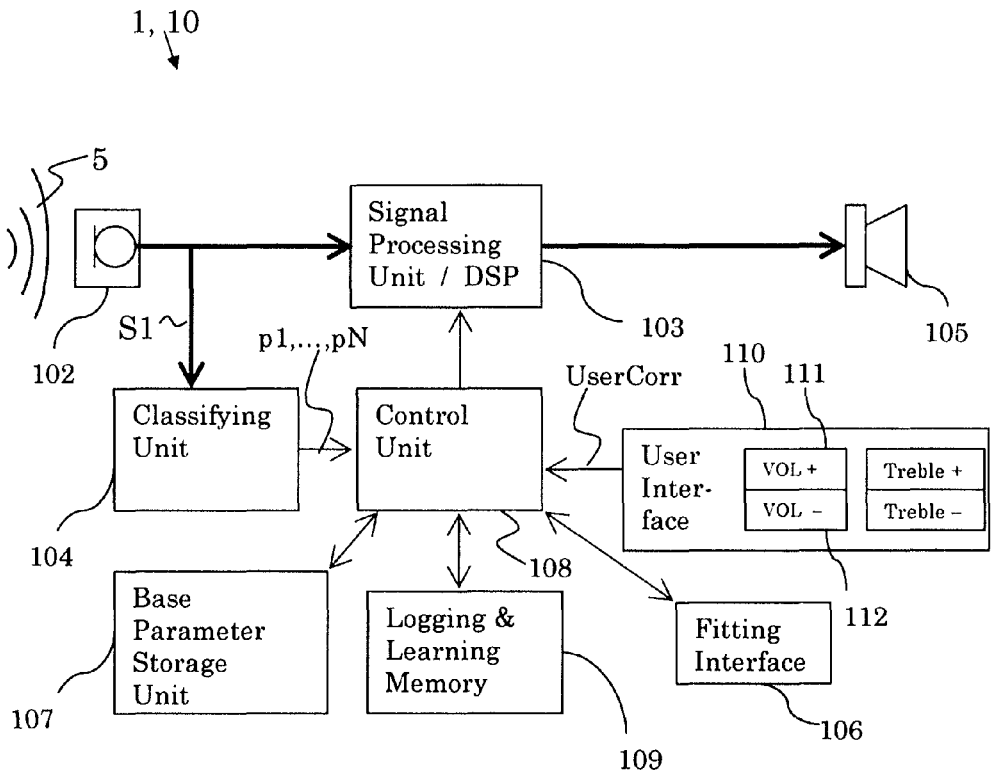
FIG. 1 a block diagrammatical illustration of a hearing system.

FIG. 1 shows a block diagrammatical illustration of a hearing system 1. The hearing system 1 can be identical to a hearing device 10 or can comprise a hearing device and one or more further devices.

The hearing system 1 comprises an input unit 102 such as a microphone, a signal processing unit 103 such as a digital signal processor and an output unit 105 such as a loudspeaker.

The hearing system 1 comprises furthermore a sensor unit 104 such as a classifier, a control unit 108 such as a processor, an interface unit 106 such as an interface to fitting hardware and software, a user interface 110 comprising user controls such as switches 111,112, and two storage units 107 and 109.

During normal operation of the hearing system 1, sound (sound waves) referred to as incoming sound 5, typically originating in the acoustic environment in which a user of the hearing system 1 is located, are converted into audio signals by input unit 102. These audio signals are fed into signal processing unit 103, and the processed audio signals are converted by output unit 105 into signals to be perceived by the hearing system user, typically sound. The audio processing properties of signal processing unit 103 are adaptable by adjustable audio processing parameters so as to allow to adapt the processing to the needs of the hearing system user.

The audio signals outputted by input unit 102 are also fed, after optional processing, as audio signals S1 into sensor unit 104. Sensor unit 104 will output characterizing data which characterize a magnitude sensed by sensor unit 104, e.g., the acoustic environment as represented by audio signals S1. If sensor unit 104 comprises a classifier which classifies the (current) acoustic environment according to N classes (N≥2), each class representing a base class such as "pure speech", "speech in noise", "noise", "music" or the like, said characterizing data can comprise a similarity vector p1, . . . , pN comprising one similarity factor (or similarity value) for each of said N classes, wherein such a similarity factor is indicative of the similarity (likeness) between the sensed (current) acoustic environment and the respective base class. Preferably, the similarity factors are normalized such that the sum of the similarity factors of all classes is 1 (or 100%).

In storage unit 107, there will be (at least) one set of base parameters for each of said N classes. Based on these sets of base parameters, audio processing parameters to be used in processing unit 103 can be chosen in dependence of the similarity vector. This is controlled by control unit 108.

Accordingly, the hearing system 1 can automatically adapt its signal processing properties in dependence of the current acoustic environment. Nevertheless, it is possible that the user is not always content with the signals he is presented with. In order for the user to carry out adjustments by himself whenever he feels a need to do so, there is provided user interface 110, e.g., with user controls 111,112 for adjusting the overall output volume and further user controls such as for adjusting the high frequency content of the output signals of the hearing system 1. Operating a user control such as 110 or 111, will lead to the generation of adjustment data (indicated as "userCorr"), which are fed to control unit 108 so that the corresponding audio processing parameter(s) is/are adjusted, usually with immediate effect.

The invention is closely related to ways of "learning" from adjustments the user carries out, in particular "learning" in the sense of finding better audio processing parameter settings, such as improved sets of base parameter settings.

Storage unit 109 is used for the learning and can also be used for data logging or, more concretely, for storing the adjustment data (userCorr). As will become clear, it is possible to dispense with storing large amounts of adjustment data, because it is possible to determine improved parameter settings "on the run", i.e. during normal operation of the hearing system 1, so that an online evaluation of the adjustment data (userCorr) takes place, which allows to delete adjustment data already after a short time.

In the following, the invention will be discussed in detail by further figures, wherein it will partially be referred to FIG. 1, too.

Figure 2:
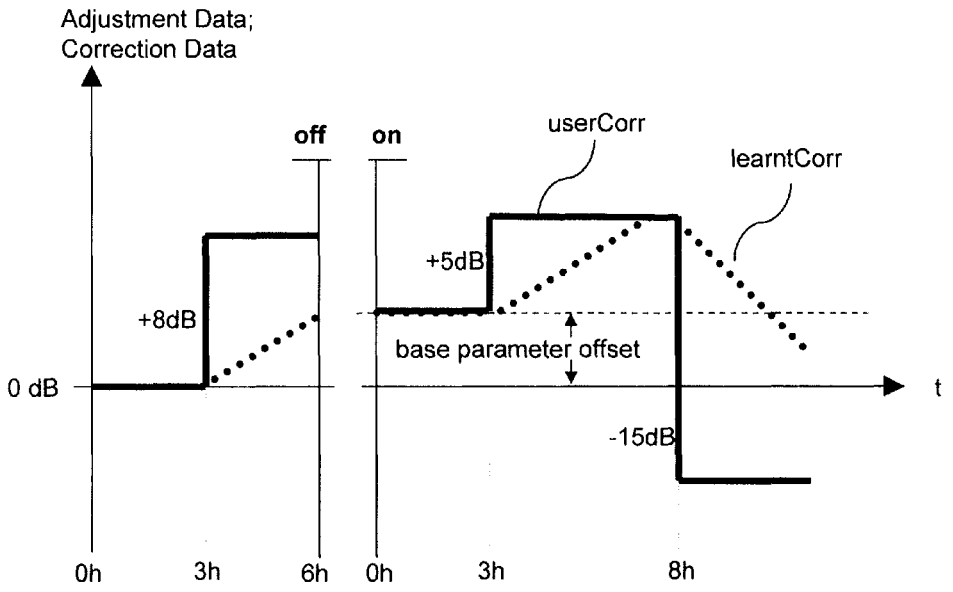
FIG. 2 a schematical curve graph for illustrating the various variables involved in learning.

FIG. 2 is a schematical curve graph for illustrating the various variables involved in learning. The bold solid lines indicate the adjustment data userCorr, whereas the dotted lines indicate correction data learntCorr obtained from the adjustment data. The audio processing parameter dealt with in FIG. 2 can be, e.g., the overall output level (in dB).

In the beginning, a default value as given by the appropriate base parameter settings is used. After three hours, the user increases the volume by 8 dB, i.e. the adjustment data userCorr will amount to +8 dB. According to a time-dependent function, the correction data learntCorr will gradually and monotonously develop towards the userCorr value of +8 dB. Another three hours later, the user switches off his hearing system. Up to that time, the hearing system 1 "learnt" about 50% of the userCorr, corresponding to a learntCorr of about +4 dB.

The switching-on of the hearing system is used as an update event, which means that the so-far learnt correction data (learntCorr=+4 dB) are used as an offset (also referred to as base parameter offset) for the default parameter settings given by the base parameter settings. Accordingly, when switching on the hearing system again, an initial setting of the volume will be about 4 dB increased with respect to the setting used at the last switching-on. I.e. userCorr=+4 dB. And learntCorr=+4 dB.

After three hours, the user again perceives the signals provided by the hearing system as too soft and increase the volume (using user control 111) again, this time by 5 dB, thus selecting userCorr=+9 dB. Again, learntCorr will slowly develop towards the new userCorr and this time will reach userCorr.

Several hours later, the user decrease the volume by 15 dB such that userCorr=−6 dB, and learntCorr will follow userCorr again.

In a similar fashion, the learning of other adjustable audio processing parameters is possible.

Figure 8:
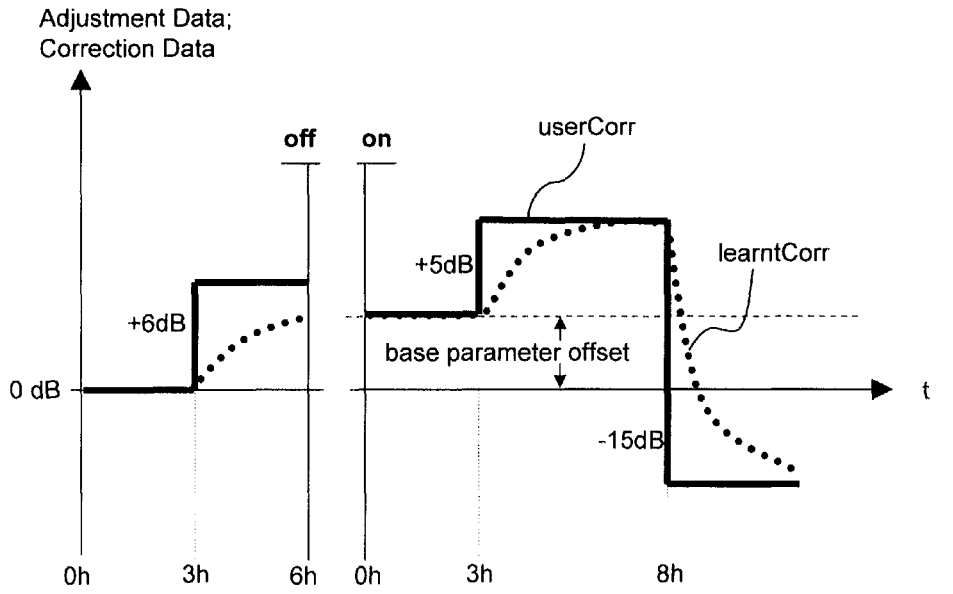
FIG. 8 a schematical curve graph for illustrating the various variables involved in learning.

FIG. 8 is a schematical curve graph for illustrating the various variables involved in learning, which is similar to FIG. 2. It illustrates a different time-dependent function according to which learntCorr evolves towards userCorr.

Figure 3:
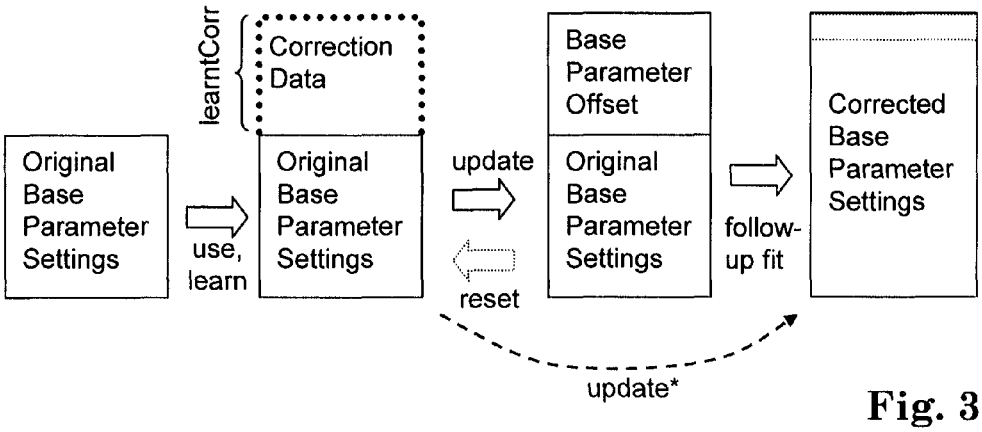
FIG. 3 a schematic diagram illustrating how correction data can be applied to a set of base parameter settings.

FIG. 3 shows a schematic diagram illustrating how correction data can be applied to a set of base parameter settings. When the hearing system is used for the first time after a fitting session, initially the base parameter settings as set by the hearing device professional will be active. Then, the user uses the hearing system and adjusts parameters (cf. also FIGS. 2 and 8), i.e. he applies corrections (userCorr) to these parameters, and the hearing system will learn from these adjustments (learntCorr; cf. also FIGS. 2 and 8). I.e. correction data are generated.

When the device is switched off and back on again, this can be considered an update event, the learnt correction (learntCorr) is added as an offset to the base parameter settings. It is possible to provide—as indicated by the dotted arrow labelled reset—that the user can decide that the new settings used after the restart of the hearing system (original settings plus learntCorr as offset) shall not be further used, i.e. it can be returned to the original settings if the user prefers to do so.

During the next fitting session with the hearing device professional (follow-up fit), the offset can be added to the base parameters (or used otherwise for amending them) so as to result in corrected settings, which serve as new base parameter settings. It is also possible to provide that the hearing device professional can amend the settings resulting from the original settings and the correction data, as indicated by the dotted portion of the corrected base parameter settings.

It is to be noted that, upon an update event, it is possible to directly derive corrected setting, without the intermediate steps of using learntCorr as an offset and involving the hearing device professional. In FIG. 3, this is indicated by the dashed arrow labelled "update*". The main—and rather unimportant—difference between such a procedure and the procedure implied by FIGS. 2, 8 and 3 is where the zero-reference line for userCorr and learntCorr is located (cf. FIGS. 2 and 8). In FIGS. 2 and 8, the zero line would coincide with the thin dashed line used for indicating the base parameter offset. And the base parameter offset would indicate the difference between the original (old) base parameter settings and the new base parameter settings (corrected settings).

It is advantageous to provide a copy of (original) base parameter settings as set by the hearing device professional, because in that way, the hearing device professional can easily see which changes have taken place. This can, nevertheless also be achieved by storing the original settings at the hearing device professional's place (where plenty of storage space is easily available, unlike in a hearing system, in particular in a hearing device). In the first-described effect of an update event, the original settings are automatically still stored in the hearing system.

Figure 4:
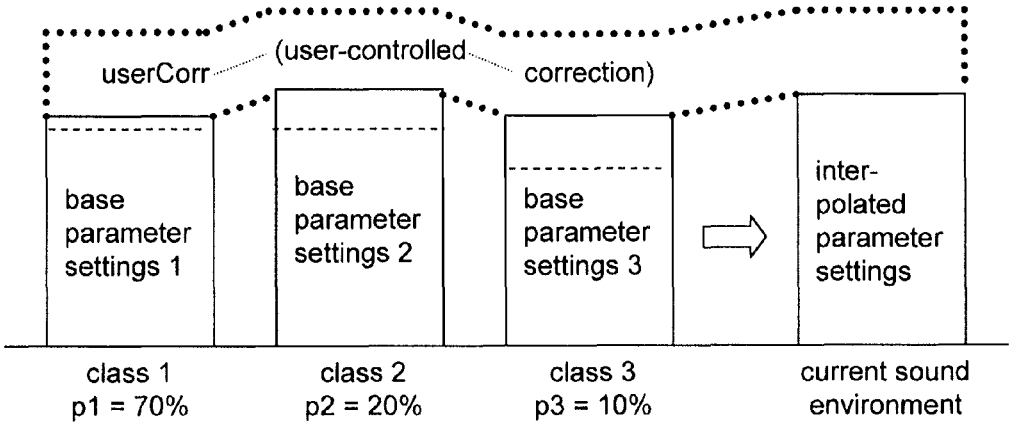
FIG. 4 a schematic diagrammatical illustration of how an interpolated parameter set can be obtained in a hearing system with "mixed-mode" classification.

FIG. 4 shows a schematic diagrammatical illustration of how an interpolated parameter set can be obtained in a hearing system with "mixed-mode" classification. In what is referred to as mixed-mode classification, base parameter settings are mixed in dependence of the output of a sensor unit 104 for obtaining interpolated parameter settings.

We shall assume for this example that sensor unit 104 is a classifier. In a given situation, the classifier for N=3 classes outputs similarity factors as indicated in FIG. 4, i.e. the similarity of the current acoustic environment with each of the three base classes is p1=70%, p2=20% and p3=10%, respectively. Each class has base parameter settings, and the parameter settings to be used in signal processor 103 is obtained as a function of these base parameter settings and the similarity values. E.g., these interpolated parameter settings can be obtained as a linear combination of the base parameter settings of the classes. As indicated by the dashed lines, the base parameter settings of the classes as shown in FIG. 4 can be understood to be composed of original base parameter settings and an offset, wherein the offset is learnt.

Confer also above the discussion of the updating in conjunction with FIGS. 2, 8 and 3.

If the user did adjust at least one audio processing parameter, as indicated by the dotted lines, the parameters used in signal processing unit 103 will be composed of said interpolated parameter settings and the user adjustments (userCorr).

For the purpose of learning, it can be very valuable to separately provide correction data (learntCorr) for different classes.

It can be very valuable if, for the purpose of learning, the "learning speed" depends on characterizing data such as the similarity factors. For example, it can be useful to leave correction data (learntCorr) unchanged for such classes which have a very low similarity factor.

Formula (1) describes a weighted averaging function. This formula can be used for the above-mentioned time-dependent function according to which learntCorr evolves towards userCorr.

$$\text{learntCorr_}i_{(t)}=(1-\text{weight_}i)*\text{learntCorr_}i_{(t-1)}+\text{weight_}i*\text{userCorr} \quad (1)$$

Therein, i=1, . . . , N; N is number of classes t: time variable, time-dependent index weight_i: weight factor; weight_i∈[0;1]

The learning speed, which determines, how fast learntCorr evolves towards userCorr, is basically determined by the weight factor. The weight factor for a class i advantageously depends on the similarity factor of class i. For example, it can be defined by Formula 2:

$$\text{weight_i} = \frac{1}{\tau} * f_{p_i}(\text{p_i}) \quad (2)$$

Therein:

τ: time constant; parameter determining general "learning speed" (he time constants are typically between 1 hrs and 4 days, and more likely between 8 hrs and 36 hours.)

fp_i(p_i): similarity-dependent function

Note that pi means the same as p_i, namely the similarity factor of class i.

More generally, the similarity-dependent function can be fp_i(p1, . . . , pN), i.e. it can depend also on the similarity factors of other classes.

Figure 5:
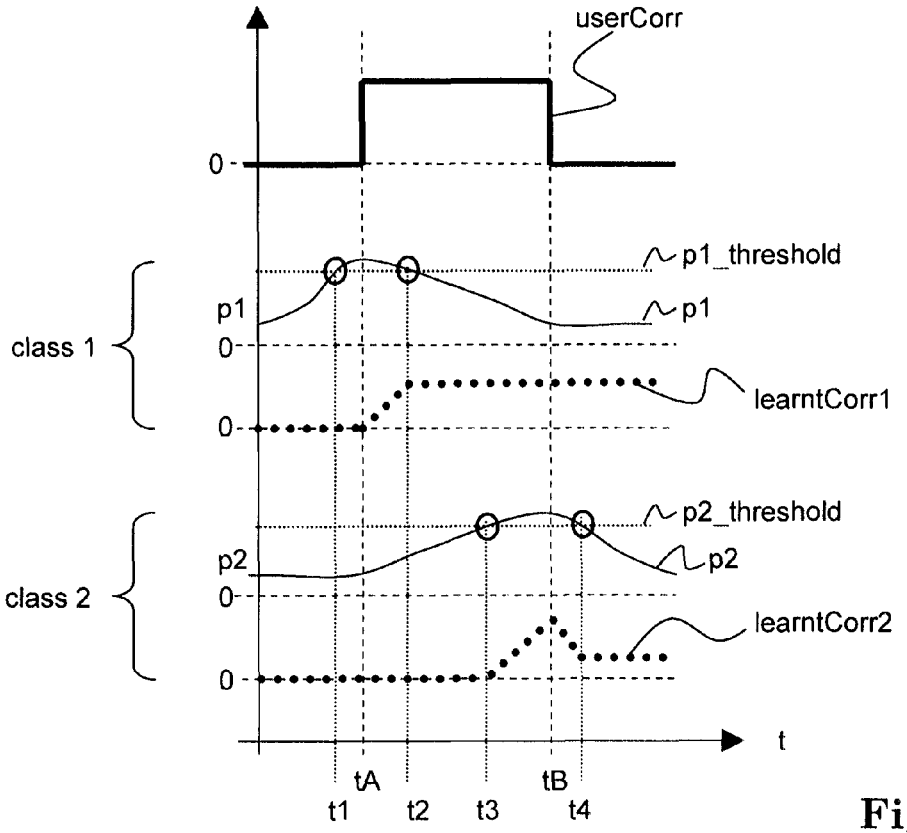
FIG. 5 a schematical curve graph illustrating an embodiment, in which learning is only active in a class if the similarity factor of that class is above a threshold.

FIG. 5 shows a schematical curve graph illustrating an embodiment, in which learning is only active in a class if the similarity factor of that class is above a threshold. The similarity-dependent function describing the learning behaviour in FIG. 5 can be described by Formula (4):

$$f_{p_i}(\text{p_i}) = \begin{cases} 1 & \text{for} \quad \text{p_i} > \text{p_i_threshold} \\ 0 & \text{for} \quad \text{p_i} \le \text{p_i_threshold} \end{cases} \quad (4)$$

I.e., below the similarity threshold, no learning takes place of the respective class, and above the threshold, learning takes place, at a learning speed as given by time constant τ. The similarity thresholds can be identical or different for different classes. Preferred values for threshold are between 0.5 and 0.7 (at similarity factors normalized to 1).

Referring to the top portion of FIG. 5, the user carries out an adjustment of an audio processing parameter at time tA, and he undoes the adjustment at time tB. In the middle portion of FIG. 5, data referring to class 1 are shown, in particular the evolution of class similarity factor p1 with time (obviously, the acoustic environment changes with time) and the correction data learntCorr1 for class 1 as a function of time. In the lower portion, the situation for class 2 is shown in a similar manner.

At t1, p1 exceeds the threshold: learning can begin. Since no adjustment has been carried out, learntCorr remains zero. At tA, the user adjustment is carried out, and learntCorr1 develops towards the current userCorr value. From t2 on, learntCorr1 remains unchanged, because p1 drops below the threshold.

At t3, p2 exceeds the threshold, and learning can begin for class 2: learntCorr2 rises towards userCorr. When at tB, userCorr drops, learntCorr2 follows userCorr again. At t4 finally, p2 drops below the threshold, so learning stops and learntCorr stays constant.

It is also possible to provide that a certain degree of learning takes place for all classes, even for classes that have a similarity factor of zero. An exemplary similarity-dependent function is shown in Formula (3):

$$f_{p_i}(p_i)=[p_i*\alpha+(1-\alpha)];\alpha\in[0;1] \quad (3)$$

By means of α, it can be adjusted, how strongly the learning speed for a class shall be influenced by the respective class. If the similarity-dependent function is defined like that for all classes (and with the same α), learning is purely "global" in that not only userCorr, but also the learning speed (as given by the weight factor) is the same for all classes. At α=0, there is always maximum learning, independent of p_i, whereas at α=1, learning is directly proportional to p_i.

It is possible to provide that α and/or τ are adjustable, typically by a hearing device professional. For example, they can be adjusted such that learning speed is relatively high during the time of acclimatization and lower at later times.

Figure 6:
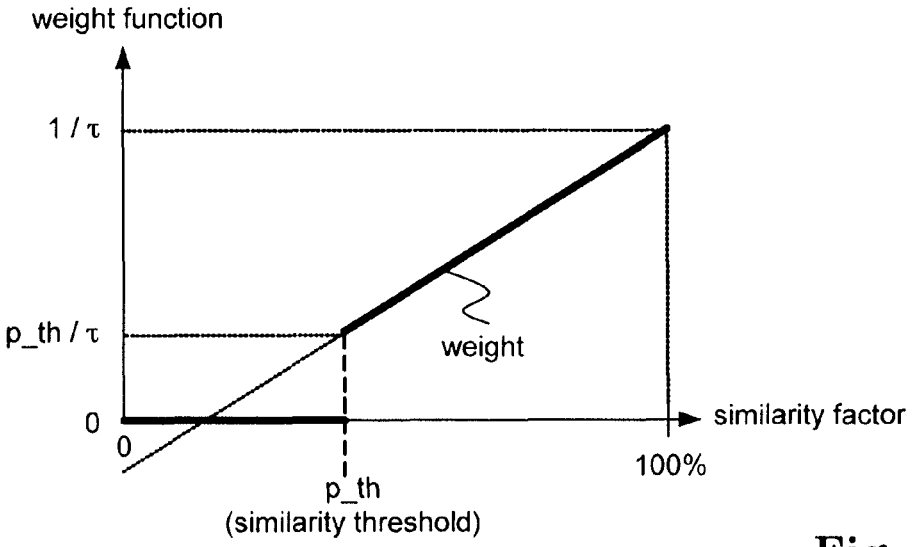
FIG. 6 an illustration of a weight function as a function of a similarity factor.

FIG. 6 is an illustration of a weight function as a function of a similarity factor. The corresponding function is given in Formula (5):

$$f_{p_i}(\text{p_i}) = \begin{cases} \text{p_i} & \text{for } \text{p_i} > \text{p_threshold} \\ 0 & \text{for } \text{p_i} \le \text{p_threshold} \end{cases} \quad (5)$$

In this embodiment, learning is enabled only above a threshold (compare Formula (4)), but the learning speed depends on the similarity factor of the respective class. It is, in this example, directly proportional to the similarity factor.

Figure 7:
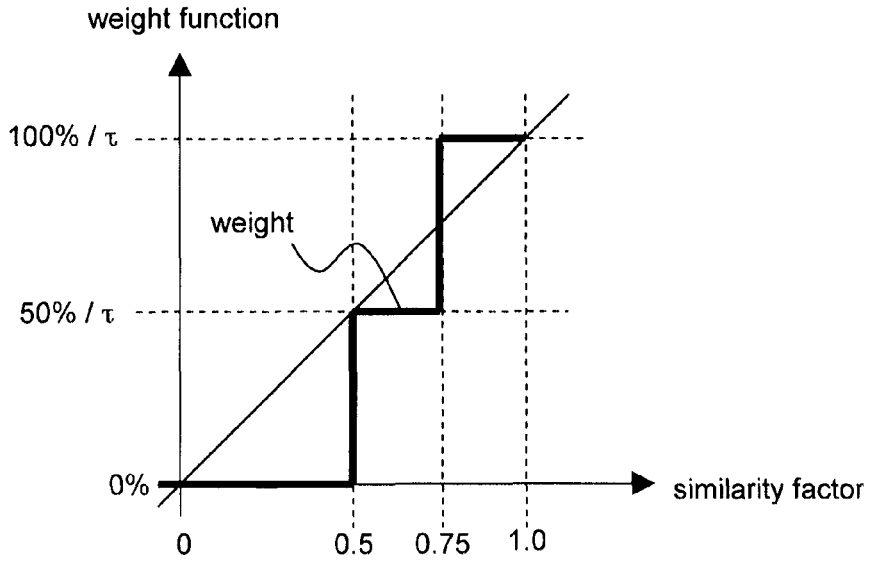
FIG. 7 an illustration of a weight function as a function of a similarity factor.

FIG. 7 is an illustration of another weight function as a function of a similarity factor. In this case, the learning speed increases step-wise from no learning up to a similarity factor of 0.5, to 50% of the maximum learning speed for 0.5<p<0.75, to full learning speed (1/τ) above a similarity factor of 0.75.

It is also possible to combine aspects of the Formulae (4) and (3), e.g., as shown in Formula (6):

$$f_{p_i}(\text{p_i}) = \begin{cases} [\text{p_i} * \alpha + (1-\alpha)] & \text{for } p1 > \text{p_threshold} \\ 0 & \text{for } p1 \le \text{p_threshold} \end{cases}; \quad \alpha \in [0; 1] \quad (6)$$

As will have become clear, there are various possibilities to define similarity-dependent functions, many of which have not been explicitly mentioned, but they all have in common that the learning speed (the weight factor) depends on at least one similarity factor, which is very valuable to have, since it can increase the quality of the learned corrections.

The variability of the user input can be taken into consideration to define the learning speed. The higher the variability the lower the learning speed and vice versa.

Please note that for the sophisticated learning put forward in the above, it is not necessary, that the parameter settings actually used in the signal processing unit 103 are determined using a classifier. And, even, if a classifier is used for that, it is possible to use "fixed-mode" classification for that, which means that the base parameter settings of that one class are used, which has the largest similarity factor (no mixing/interpolating of base parameter sets of different classes).

It is possible to either provide more than one set of base parameter settings per class, each for different times of the day and/or for different days of the week or for different sound pressure levels or other, typically acoustic parameters, or to provide a correspondingly increased amount of classes. This can help to better adjust the hearing system to the user's preferences, and the above-sketched procedures can be carried out analogously in these cases.

By means of the invention, an increased stability of the learning can be achieved, and resulting corrected settings are likely to correspond closely to settings the hearing system user really prefers. The invention enables an improved self-adjusting hearing system. The self-adjusting to the user's preferences depends, in a sophisticated way, on audio processing parameter adjustments the user himself carries out.

LIST OF REFERENCE SYMBOLS

1 hearing system
5 incoming sound
10 hearing device
102 input unit, input transducer unit, microphone unit
103 signal processing unit, signal processor, digital signal processor
104 sensor unit, classifying unit, classifier
106 interface unit, interface to fitting hardware
107 storage unit
108 control unit
109 storage unit
110 user interface
111 user control
112 user control
learntCorr correction data
p1, . . . , pN similarity factors (for classes 1 . . . N)
p1_threshold similarity threshold for class 1
p2_threshold similarity threshold for class 2
S1 input audio signals
userCorr adjustment data

What is claimed is:

1. A method for operating a hearing system comprising at least one hearing device;

at least one signal processing unit;

at least one user control by means of which at least one audio processing parameter of said signal processing unit is adjustable;

a sensor unit;

said method comprising the steps of a) obtaining adjustment data representative of adjustments of said at least one parameter carried out by operating said at least one user control;

b) obtaining characterizing data from data outputted from said sensor unit substantially at the time said adjustment data are obtained;

c) determining an amount of contribution of said adjustment data based on said characterizing data;

d) deriving correction data from said adjustment data based on the determined amount of contribution of adjustment data;

e) recognizing an update event; and, upon step e):

f) using corrected settings for said at least one audio processing parameter in said signal processing unit, which corrected settings are derived in dependence of said correction data.

2. The method according to claim 1, wherein a time-dependent function is used for carrying out step d).

3. The method according to claim 2, wherein step d) is carried out such that said correction data develop in time towards said adjustment data.

4. The method according to claim 2, wherein said time-dependent function is a recursive function.

5. The method according to claim 2, wherein said time-dependent function describes a weighted averaging function.

6. The method according to claim 1, wherein said sensor unit receives sound.

7. The method according to claim 6, wherein said characterizing data comprise data characterizing acoustical properties of said received sound.

8. The method according to claim 6, wherein said sensor unit comprises a classifying unit for classifying said received sound according to N sound classes, with an integer N≥2.

9. The method according to claim 8, wherein said characterizing data comprise similarity factors which are indicative of the similarity between said received sound and sound representative of a respective class.

10. The method according to claim 8, wherein said hearing system comprises a storage unit comprising at least one set of base parameter settings for each of said N≥2 classes, and wherein said correction data are derived for each of said N≥2 classes, and wherein for each of said N≥2 classes, corrected settings are derived in dependence of the correction data and of said base parameter settings of the respective class.

11. A hearing system comprising at least one hearing device;

at least one signal processing unit;

a user interface comprising at least one user control by means of which at least one audio processing parameter of said signal processing unit is adjustable;

a sensor unit;

a control unit operationally connected to each of the above elements;

wherein said control unit is adapted to a) obtaining adjustment data representative of adjustments of said at least one parameter carried out by operating said at least one user control;

b) obtaining characterizing data from data outputted from said sensor unit substantially at the time said adjustment data are obtained;

c) determining an amount of contribution of said adjustment data based on said characterizing data d) deriving correction data from said adjustment data based on the determined amount of contribution of adjustment data;

e) recognizing an update event; and, upon step e):

f) using corrected settings for said at least one audio processing parameter in said signal processing unit, which corrected settings are derived in dependence of said correction data.

12. A non-transitory computer-readable storage medium having stored thereon computer program products comprising program codes for causing a computer to perform the steps of A) obtaining adjustment data representative of adjustments of at least one audio processing parameter of a signal processing unit of a hearing system carried out by operating at least one user control of said hearing system;

B) obtaining characterizing data from data outputted from a sensor unit of said hearing system substantially at the time said adjustment data are obtained;

C) determining an amount of contribution of said adjustment data based on said characterizing data D) deriving correction data from said adjustment data based on the determined amount of contribution of adjustment data;

E) recognizing an update event; and, upon step E):

F) using corrected settings for said at least one audio processing parameter in said signal processing unit, which corrected settings are derived in dependence of said correction data.

13. The non-transitory computer-readable storage medium according to claim 12, wherein said computer is comprised in said hearing system.

14. The non-transitory computer-readable storage medium according to claim 12, wherein said sensor unit receives sound.

15. The non-transitory computer-readable storage medium according to claim 12, wherein said user control is part of a user interface.

16. A method for operating a hearing system comprising at least one hearing device;

at least one signal processing unit;

at least one user control by means of which at least one audio processing parameter of said signal processing unit is adjustable;

a sensor unit;

said method comprising the steps of a) obtaining adjustment data representative of adjustments of said at least one parameter carried out by operating said at least one user control;

b) obtaining characterizing data from data outputted from said sensor unit substantially at the time said adjustment data are obtained;

c) determining an amount of contribution of said adjustment data based on said characterizing data;

d) deriving correction data from said adjustment data based on the determined amount of contribution of adjustment data;

e) recognizing an update event; and, upon step e):

f) using corrected settings for said at least one audio processing parameter in said signal processing unit, which corrected settings are derived in dependence of said correction data, wherein said sensor unit receives sound and comprises a classifying unit for classifying said received sound according to N sound classes, with an integer N≥2, wherein said hearing system comprises a storage unit comprising at least one set of base parameter settings for each of said N≥2 classes, wherein said correction data are derived for each of said N≥2 classes, and wherein for each of said N≥2 classes, corrected settings are derived in dependence of the correction data and of said base parameter settings of the respective class.

* * * * *